US011287128B2

(12) United States Patent
Shaw

(10) Patent No.: US 11,287,128 B2
(45) Date of Patent: Mar. 29, 2022

(54) INWARD FIRED LOW $NO_X$ PREMIX BURNER

(71) Applicant: Carrier Corporation, Palm Beach Gardens, FL (US)

(72) Inventor: Robert Shaw, Indianapolis, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 244 days.

(21) Appl. No.: 16/722,780

(22) Filed: Dec. 20, 2019

(65) Prior Publication Data

US 2020/0124280 A1 Apr. 23, 2020

Related U.S. Application Data

(60) Provisional application No. 62/788,019, filed on Jan. 3, 2019.

(51) Int. Cl.
*F23D 14/02* (2006.01)
*F23K 5/00* (2006.01)

(52) U.S. Cl.
CPC ..... *F23K 5/007* (2013.01); *F23D 14/02* (2013.01); *F23D 2203/007* (2013.01)

(58) Field of Classification Search
CPC ..... F23K 5/007; F23D 14/02; F23D 2203/007
USPC ..... 431/2
See application file for complete search history.

(56) References Cited

U.S. PATENT DOCUMENTS

| | | | | |
|---|---|---|---|---|
| 2,649,850 | A * | 8/1953 | Schlenk | F24C 3/10 126/39 K |
| 4,485,972 | A * | 12/1984 | Freber | A47J 37/0682 126/39 R |
| 4,664,619 | A | 5/1987 | Johnson et al. | |
| 5,044,558 | A | 9/1991 | Young et al. | |
| 5,055,032 | A | 10/1991 | Altemark et al. | |
| 5,865,611 | A * | 2/1999 | Maiello | F23N 5/022 431/12 |
| 6,357,222 | B1 | 3/2002 | Schilling et al. | |
| 7,934,538 | B2 * | 5/2011 | Obayashi | F28F 9/12 165/76 |
| 8,616,194 | B2 | 12/2013 | Sherrow et al. | |
| 8,661,825 | B2 | 3/2014 | Desai et al. | |
| 8,919,337 | B2 | 12/2014 | Schultz et al. | |
| 8,985,999 | B2 | 3/2015 | Sherrow et al. | |
| 9,933,163 | B2 | 4/2018 | Sherrow et al. | |

FOREIGN PATENT DOCUMENTS

| | | |
|---|---|---|
| CN | 204227711 | 3/2015 |
| CN | 101892903 | 10/2015 |
| CN | 106439822 | 2/2017 |
| CN | 108489100 | 9/2018 |
| WO | 2017018992 | 2/2017 |

* cited by examiner

*Primary Examiner* — Avinash A Savani
(74) *Attorney, Agent, or Firm* — James A. Edwards

(57) ABSTRACT

A gas manifold assembly for delivering fuel from a fuel source to a burner assembly includes a gas manifold tube configured to deliver fuel from the fuel source and a stub tube mounted to and arranged in fluid communication with the burner assembly. An end of the gas manifold tube is connectable to the stub tube to form a slip joint.

4 Claims, 7 Drawing Sheets

INWARD FIRED LOW $NO_X$ PREMIX BURNER

CROSS REFERENCE TO A RELATED APPLICATION

The application claims the benefit of U.S. Provisional Application No. 62/788,019 filed Jan. 3, 2019, the contents of which are hereby incorporated in their entirety.

BACKGROUND OF THE INVENTION

The subject matter disclosed herein relates to heating systems. More specifically, the subject disclosure relates to burners for residential and commercial heating systems.

Heating systems, in particular furnaces, include one or more burners for combusting a fuel such as natural gas. Hot flue gas from the combustion of the fuel proceeds from the burner and through a heat exchanger. The hot flue gas transfers thermal energy to the heat exchanger, from which the thermal energy is then dissipated by a flow of air driven across the heat exchanger by, for example, a blower.

A typical prior art construction is shown in FIG. 1. A burner 10 is located external to a heat exchanger 12. The burner 10, often referred to as an inshot burner 10, receives a flow of fuel from a fuel source 14. An ignition source 16 combusts the flow of fuel to create a combustion flame 18.

Another type of burner is a premix burner in which fuel and air are mixed prior to reaching an ignition source that ignites the mixture. Premix burners, compared to inshot burners, typically emit much lower levels of NOR, the emissions of which are tightly regulated and restricted by many jurisdictions. Because of this advantage of premix burners, it may be desirable to utilize premix burners in furnaces.

BRIEF DESCRIPTION OF THE INVENTION

According to one embodiment, a gas manifold assembly for delivering fuel from a fuel source to a burner assembly includes a gas manifold tube configured to deliver the fuel from the fuel source and a stub tube mounted to and arranged in fluid communication with the burner assembly. An end of the gas manifold tube is connectable to the stub tube to form a slip joint.

In addition to one or more of the features described above, or as an alternative, in further embodiments comprising a conduit supporting the stub tube.

In addition to one or more of the features described above, or as an alternative, in further embodiments the end of the gas manifold tube and the stub tube are positioned in an axially overlapping arrangement at the slip joint.

In addition to one or more of the features described above, or as an alternative, in further embodiments the gas manifold tube axial overlaps a portion of the stub tube within the conduit.

In addition to one or more of the features described above, or as an alternative, in further embodiments an end of the stub tube extends beyond an end of the conduit.

In addition to one or more of the features described above, or as an alternative, in further embodiments the gas manifold tube axial overlaps a portion of the stub tube extending beyond the end of the conduit.

In addition to one or more of the features described above, or as an alternative, in further embodiments the end of the gas manifold tube and the stub tube are mounted concentrically at the slip joint.

In addition to one or more of the features described above, or as an alternative, in further embodiments a clearance exists between a surface of the gas manifold tube and an adjacent surface of the stub tube.

In addition to one or more of the features described above, or as an alternative, in further embodiments a seal is arranged within the clearance.

In addition to one or more of the features described above, or as an alternative, in further embodiments a surface of the gas manifold tube is arranged in direct contact with an adjacent surface of the stub tube.

In addition to one or more of the features described above, or as an alternative, in further embodiments the end of the gas manifold tube is received within a hollow interior of the stub tube.

In addition to one or more of the features described above, or as an alternative, in further embodiments an end of the stub tube is received within a hollow interior of the gas manifold tube.

According to another embodiment, a furnace includes a heat exchanger including a plurality of coils and a burner unit. The burner unit includes a burner box defining a mixing chamber for receiving a mixture of fuel and air, a burner assembly including at least one burner arranged within the mixing chamber and being substantially aligned with at least one of the plurality of coils, a fuel source, and a gas manifold assembly extending between and fluidly coupling the fuel source and the burner box to deliver fuel to the burner assembly. The gas manifold assembly is connected to the burner box via a slip joint.

In addition to one or more of the features described above, or as an alternative, in further embodiments the gas manifold assembly further comprises a gas manifold tube connected to and extending from the fuel source and a stub tube mounted to and arranged in fluid communication with the burner assembly. An end of the gas manifold tube is connectable to the stub tube to form the slip joint.

In addition to one or more of the features described above, or as an alternative, in further embodiments comprising a conduit supporting the stub tube.

In addition to one or more of the features described above, or as an alternative, in further embodiments an end of the stub tube extends beyond an end of the conduit.

In yet another embodiment, a method of assembling a burner unit of a furnace includes rigidly mounting a stub tube within a conduit extending from a burner box, affixing a bracket extending from a fuel source to an exterior surface of the burner box, and connecting a gas manifold tube extending from the fuel source to the stub tube to form a slip joint.

In addition to one or more of the features described above, or as an alternative, in further embodiments connecting the gas manifold tube to the stub tube further comprises forming an axial overlap between the gas manifold tube and the stub tube.

In addition to one or more of the features described above, or as an alternative, in further embodiments connecting the gas manifold tube to the stub tube further comprises concentrically mounting the gas manifold tube and the stub tube.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
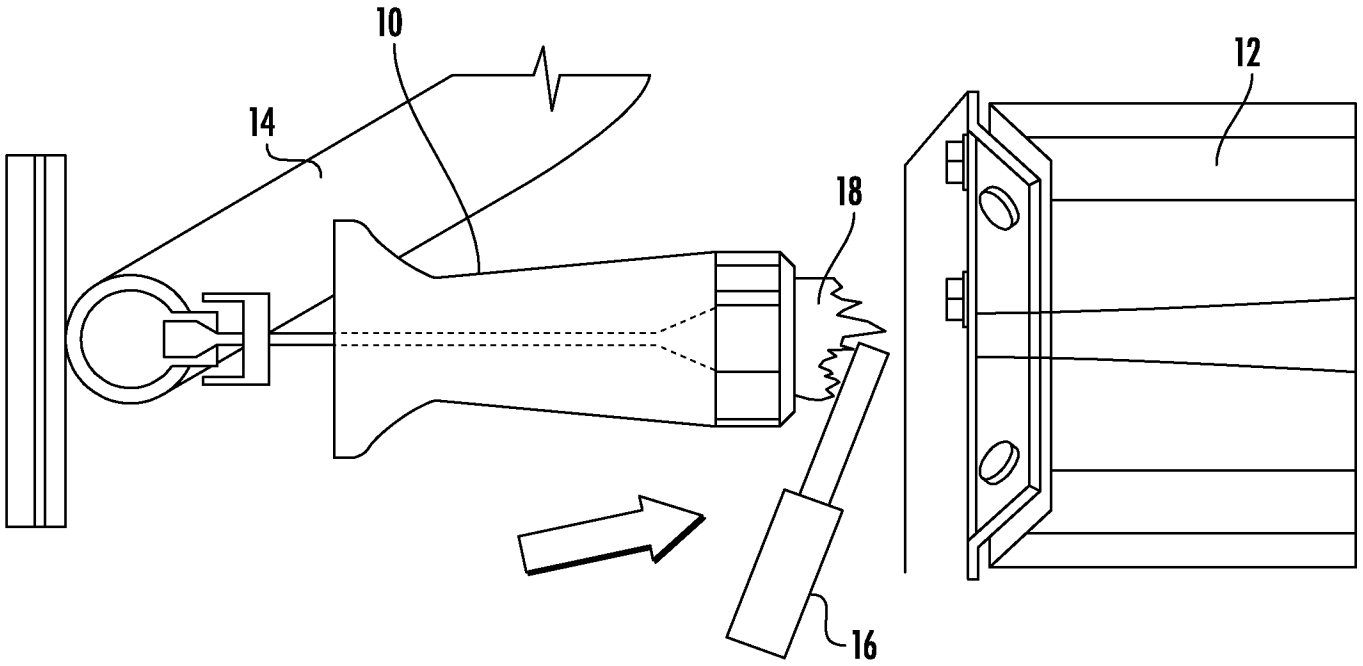
FIG. 1 PRIOR ART
FIG. 1 is a cross-sectional view of an example of a typical prior art burner arrangement.
Figure 2:
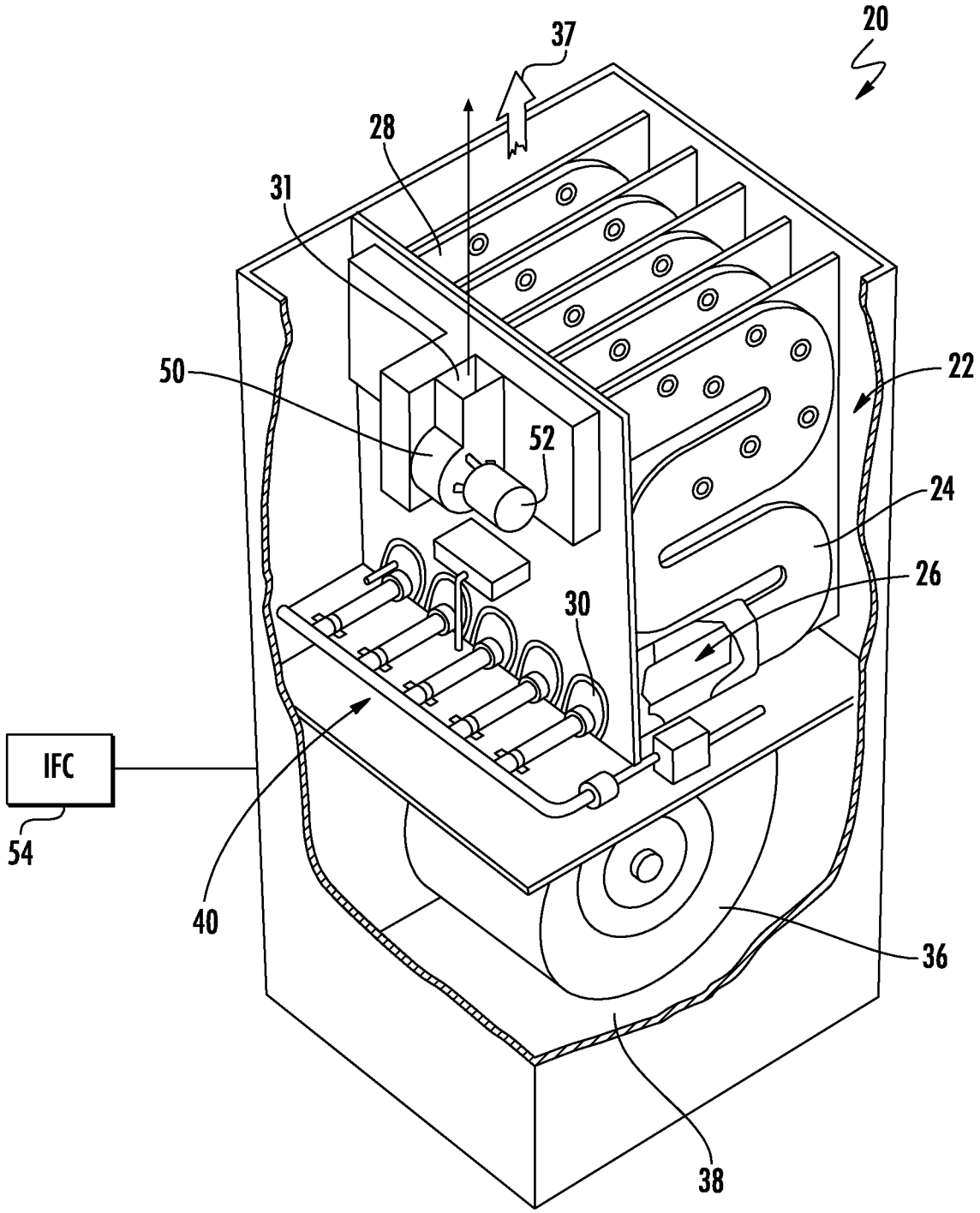
FIG. 2 is a schematic view of an embodiment of a furnace.

Referring now to the FIGS., an improved furnace 20 is illustrated in FIG. 2. The furnace 20 may include a heat exchanger 22 having a plurality of individual heat exchanger coils 24. The heat exchanger coils 24, which may be metallic conduits, may be provided in a serpentine fashion to provide a large surface area in a small overall volume of space, the importance of which will be discussed in further detail below. Each heat exchanger coil 24 includes an inlet 26 and outlet 28. A burner unit 30 is operatively associated with each inlet 26, and a vent 31 is operatively associated with each outlet 28. The burner unit 30 introduces a flame and combustion gases (not shown) into the heat exchanger coils 24, while vent 31 releases the combustion gases to atmosphere (through a flue or the like) after the heat of the flame and combustion gases is extracted by the heat exchanger 22.

In order to extract the heat, a blower motor 36 may be provided to create a significant air flow across the heat exchanger coils 24. As the air circulates across the heat exchanger coils 24, it is heated and can then be directed to a space to be heated such as a home or commercial building for example, by way of appropriate ductwork as indicated by arrow 37. The furnace 20 may also include a return 38 to enable air from the space to be heated to be recirculated and/or fresh air to be introduced for flow across the heat exchanger coils 24.

Figure 3:
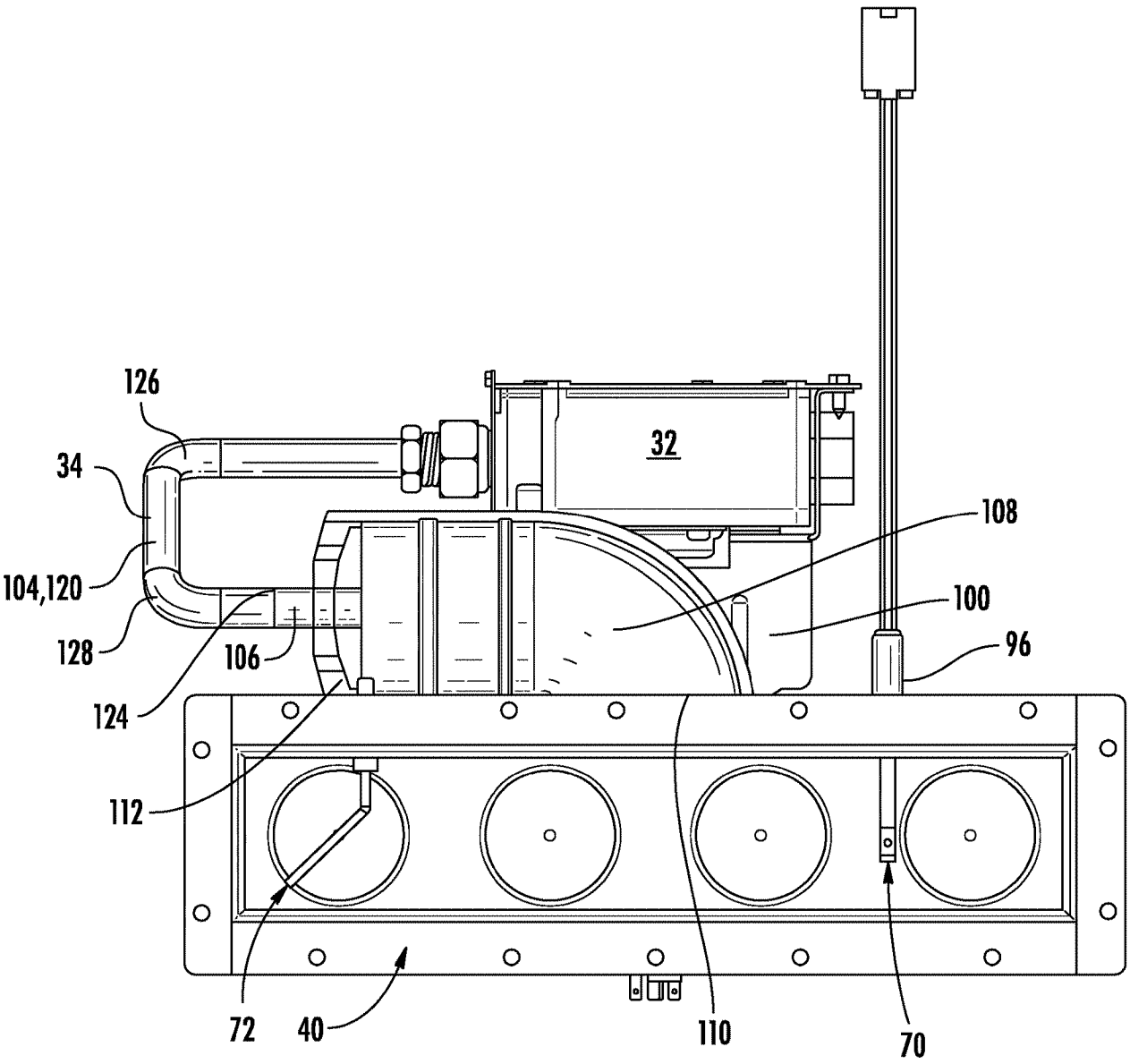
FIG. 3 is an end view of a burner unit according to an embodiment.

To generate the flame and hot combustion gases, a burner assembly 40 of the burner unit 30 premixes fuel and air and ignites the same. The fuel may be natural gas or propane introduced via a fuel source 32 fluidly coupled to the burner assembly 40 via a manifold assembly 34 (see FIG. 3). A portion or substantially all of the air necessary for combustion is introduced at an upstream end of the burner assembly 40. Such air may be introduced by inducing an airflow using a motorized induction fan 50 downstream of a burner outlet. More specifically, a motor 52 having the induction fan 50 associated therewith may be operatively associated with the outlets 28 of the heat exchanger coils 24. When energized, the induction fan 50 may rotate and induce an air flow through the heat exchanger coils 24 and burner unit 30. Control of the motor 52, may be controlled by a processor 54 such as an integrated furnace control (IFC).

Figure 4:
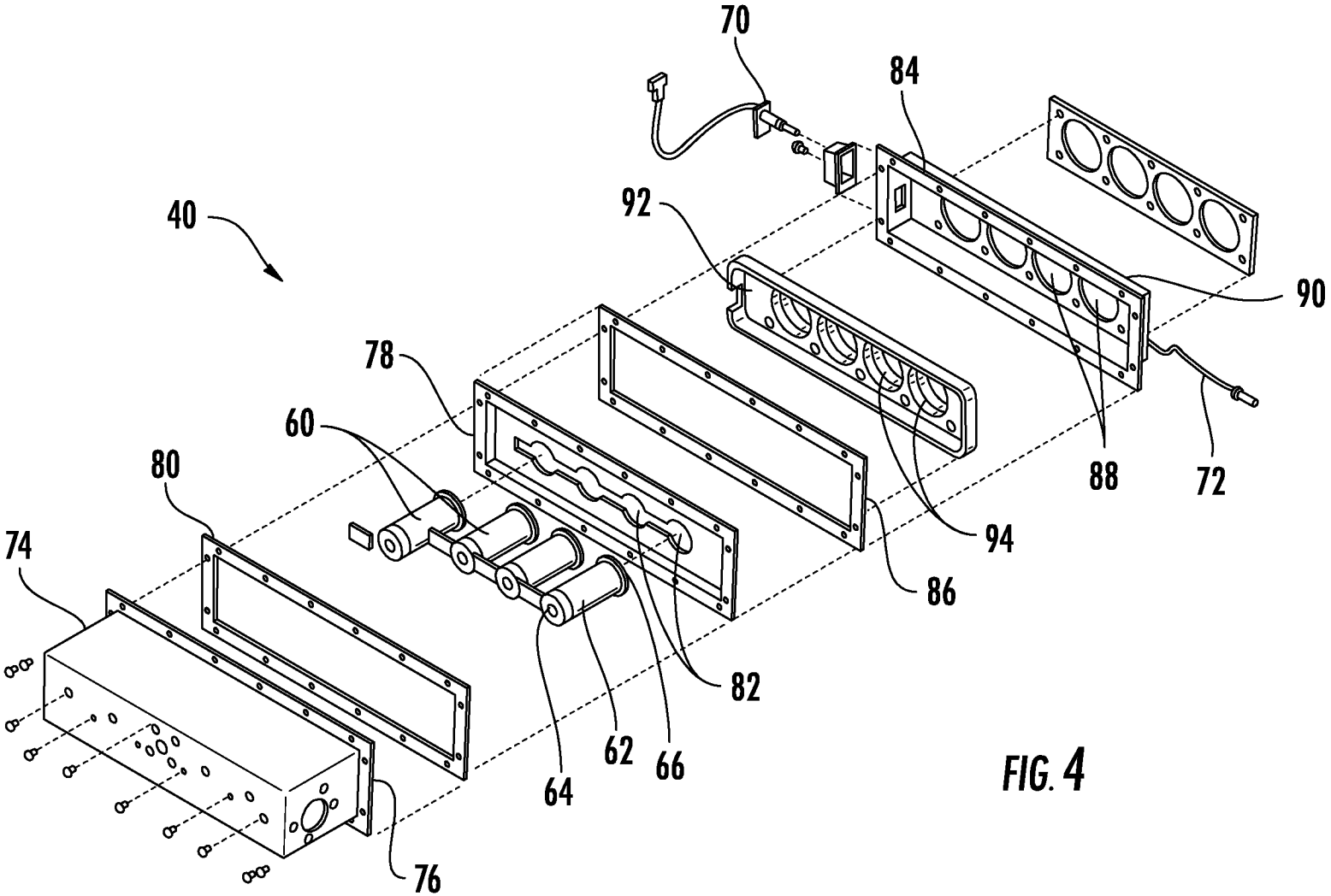
FIG. 4 is an expanded perspective view of a burner assembly of a burner unit according to an embodiment.
Figure 5:
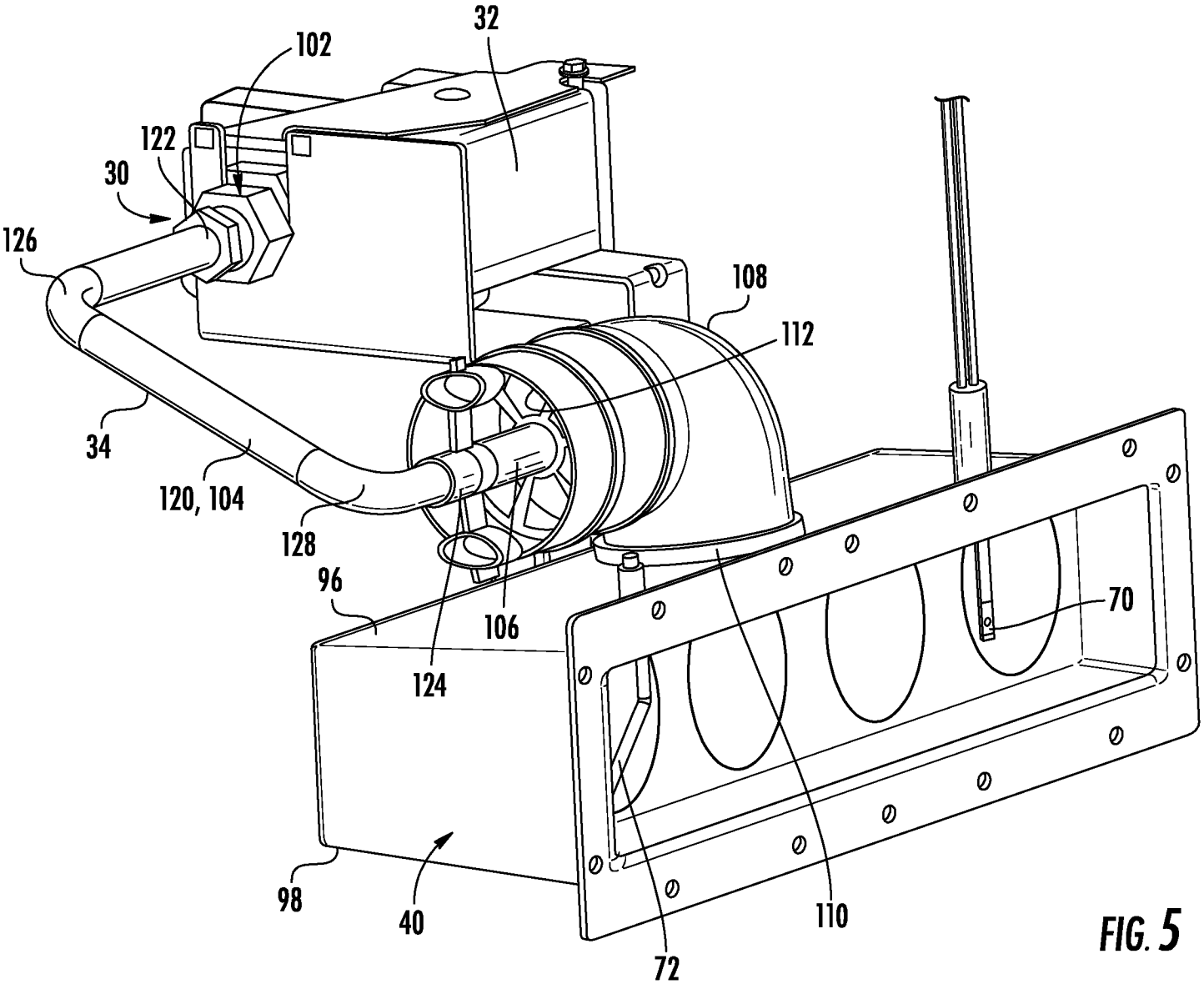
FIG. 5 is a side perspective view of a burner unit according to an embodiment.
Figure 6:
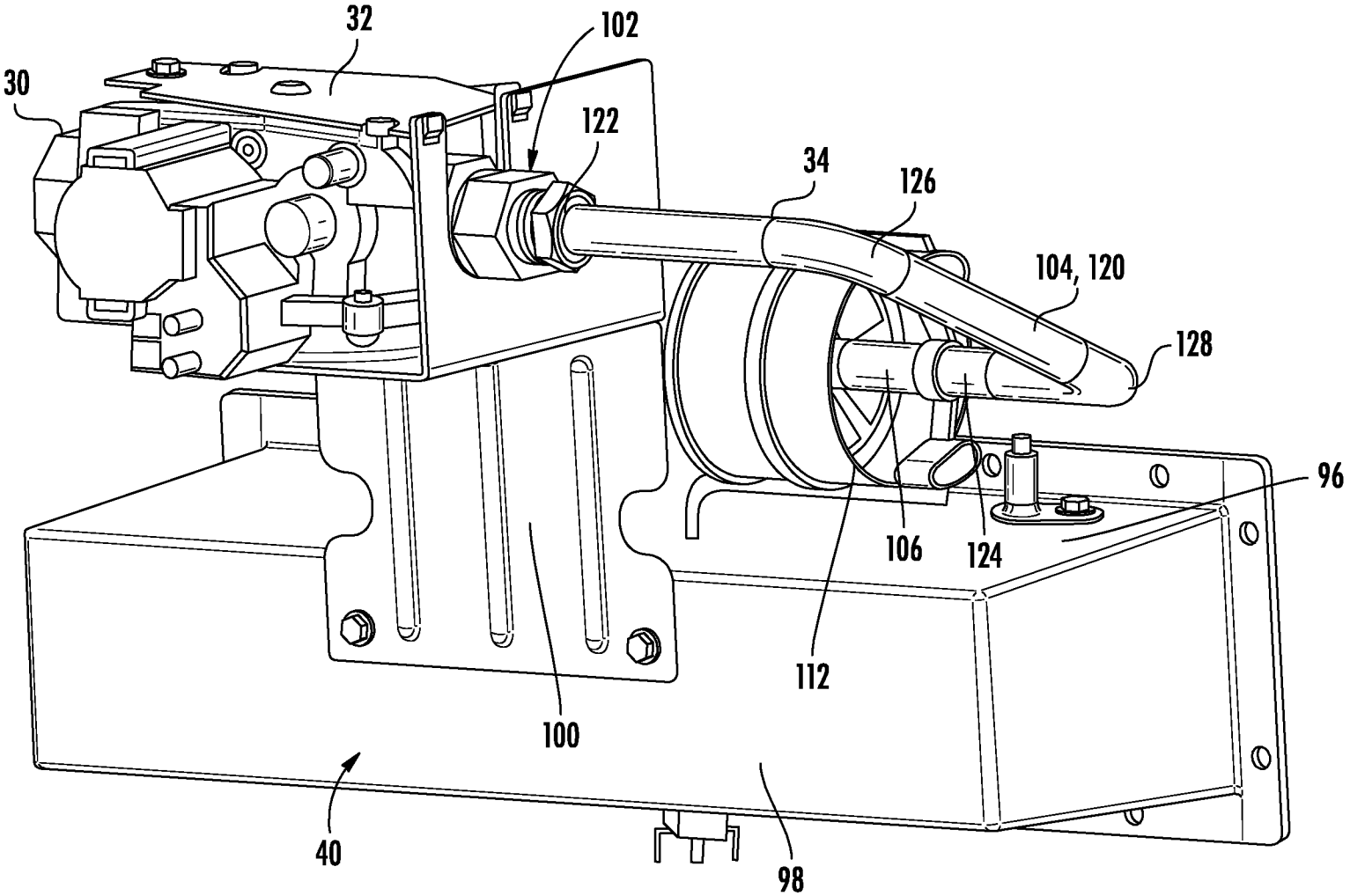
FIG. 6 is a rear perspective view of a burner unit according to an embodiment.
Figure 7:
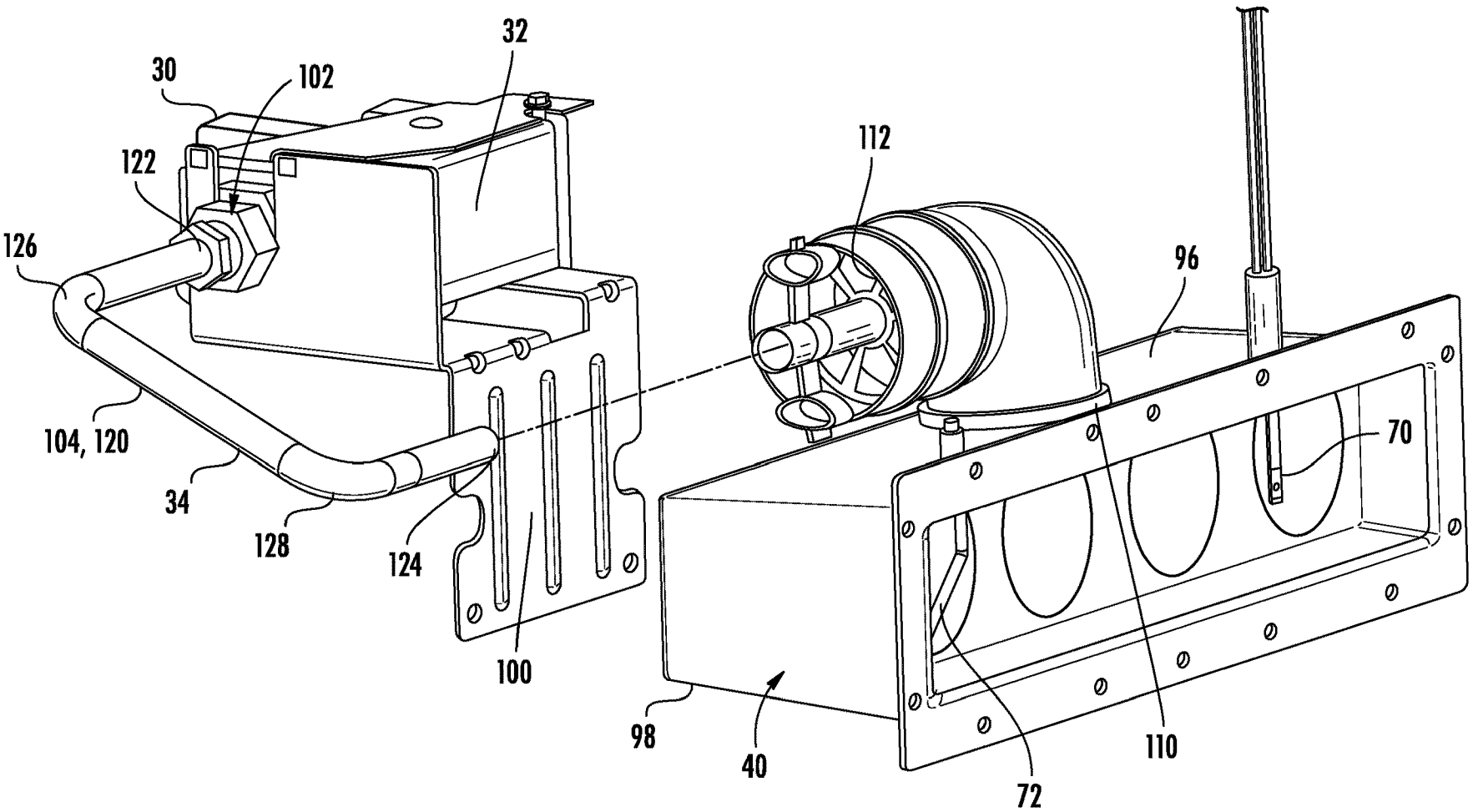
FIG. 7 is a partially expanded side view of a burner unit according to an embodiment.

An example of the burner assembly 40 of the burner unit 30 is illustrated in more detail in FIG. 4. In the illustrated, non-limiting embodiment, the burner assembly 40 includes a plurality of substantially identical burners 60 positioned within a burner box. Each burner 60 including a burner tube 62 having an inlet 64 and an outlet 66, but can be provided in other configurations as well. For example, while depicted as a cylindrical tube of constant diameter, the burner tube 62 may be provided as a restricted diameter section or a venturi, among other variations. Further, although multiple burners 60 are shown, it should be understood that embodiments having only a single burner are also contemplated herein.

A mixture of fuel provided by a fuel source and air drawn by the induction fan 50, is provided to each of the burners 60 prior to ignition. To light the burners 60, an igniter 70 is located near the burners 60, generally between the burner outlet 66 and the heat exchanger coils 24 to ignite the fuel/air mixture. Similarly, a flame sensor 72, shown generally aligned with the igniter 70, may be disposed on an opposite side of the burners 60 than the igniter 70. The flame sensor 72 is operable to determine if the ignition has carried over to each of the plurality of burners 60 by sensing the presence of a flame at the burner 60 furthest from the igniter 70.

Each of the burners 60 is positioned within a hollow interior of an outer box 74 of the burner box such that the outlet 66 of the burner 60 is adjacent an open end 76 of the outer box 74. Connected to the open end 76 of the outer box 74 and the outlet 66 of each of the plurality of burners 60 is a partition plate 78. A gasket 80 may be arranged between a portion of the open end 76 of outer box 74 and the partition plate 78 to provide a seal there between. The partition plate 78 has one or more openings 82 formed therein, each of which is substantially aligned with and fluidly coupled to the outlet 66 of a corresponding burner 60. In another embodiment, a portion of the burner tubes 62 may extend through the openings 82 formed in the partition plate 78.

In the illustrated, non-limiting embodiment, an inner box 84 is coupled to the partition plate 78, opposite the outer box 74. A gasket 86 may similarly be arranged between a portion of the partition plate 78 and the inner box 84 to form a seal there between. The inner box 84 also includes a plurality of openings 88, each of which is substantially aligned with and fluidly coupled to an opening 82 formed in the partition plate 78 and the outlet 66 of a corresponding burner 60. The heat exchanger coils 24 are positioned adjacent an exterior surface 90 of the inner box 84, such as to a cell panel (not shown) mounted thereto, in line with the plurality of openings 88, such that a fluid flow path extends from the burner outlet 66 through the partition plate 78 and inner box 84 into the heat exchanger coils 24. In some embodiments, a refractory panel 92 is disposed between a portion of the partition plate 78 and the inner box 84. As shown, the refractory panel 92 may be received within a cavity formed in the inner box 84. The refractory panel 92 includes a plurality of refractory openings 94 arranged coaxially with the plurality of openings 82 and plurality of openings 88 about a central burner axis X. The burner assembly 40 illustrated and described herein is intended as an example only, and it should be understood that a burner assembly 40 having any suitable configuration is within the scope of the disclosure.

With reference again to FIG. 3 and FIGS. 5-7, the burner unit 30 includes a fuel source 32 and a manifold assembly 34. In an embodiment, the fuel source 32 includes a gas valve. Fuel is delivered to the burner assembly 40 of the burner unit 30 from the gas valve 32 via the manifold assembly 34. As shown, the gas valve 32 may be mounted at a location offset from the burner assembly 40, for example vertically above an upper surface 96 of the outer box 74 of the burner assembly 40. In the illustrated, non-limiting embodiment, a bracket 100 extending from the gas valve 32 is mounted to a back surface 98 of the outer box 74. The bracket 100 may be integrally formed with, or alternatively, may be removably connected to the gas valve 32. The gas valve 32 additionally includes a gas orifice, jet, or other suitable mechanism 102 connected to the manifold assembly 34 to deliver fuel to the burner assembly 40.

The manifold assembly 34 extending between the gas valve 32 and the burner assembly 40 includes a first portion 104, such as a gas manifold tube, and a second portion 106, such as a stub tube. Both the gas manifold tube 104 and the stub tube 106 may be formed from any suitable material. As shown in the FIGS., the stub tube 106 is mounted to and arranged in fluid communication with the one or more burners 60 of the burner assembly 40. The stub tube 106 may be directly connected to the burner assembly 40, or alternatively, may be coupled thereto via an intermediate component 108. For example, in the illustrated, non-limiting embodiment, the stub tube 106 is connected to the burner assembly 40 via a non-linear conduit 108 mounted to an upper surface 96 of the outer box 74. A first end 110 of the conduit 108 is connected to an opening (not shown) formed in the outer box 74 and the hollow stub tube 106 extends from a sealed portion of the conduit 108 disposed between the first end 110 and the second end 112 of the non-linear conduit 108. As shown, an axis of the stub tube 106 is oriented generally parallel to the upper surface 96 of the outer box 74. However, embodiments where the stub tube 106 is oriented at a non-zero angle to the outer box 74 are also within the scope of the disclosure.

The gas manifold tube 104 includes a tube body 120 having a first end 122 and a second end 124. The cross-sectional of the tube body 120 may be generally constant between the first end 122 and the second end 124, or alternatively, may vary. As shown, the gas manifold tube 104 may have a non-linear configuration. In the illustrated, non-limiting embodiment, the body of the gas manifold tube 104 includes a first bend 126 and a second bend 128 such that the gas manifold tube 104 has a U or C-like shape. However, a gas manifold tube 104 having any configuration is within the scope of the disclosure. Although the first arm and the second arm of the tube body 120 are illustrated as being arranged generally parallel to one another, embodiments where the arms are arranged at an angle to one another are also within the scope of the disclosure. The first arm has a first axial length extending between the first bend 126 and the first end 122 of the tube body 120 and the second arm has a second axial length extending between the second bend 128 and the second end 124 of the tube body 120. In the illustrated, non-limiting embodiment, the first axial length of the first arm is greater than the second axial length of the second arm. However, embodiments where the first axial length of the first arm is less than or equal to the second axial length of the second arm are also contemplated herein.

The first end 122 of the gas manifold tube 104 is connected to the orifice 102 of the gas valve 32, such as via a flare fitting for example, and the second end 124 of the gas manifold tube 104 is slidably connected to the stub tube 106 to form a "slip joint". In some embodiments, a fastening mechanism or connector (not shown) may be used to retain the slidable engagement between the second end 124 of the gas manifold tube 104 and the stub tube 106 at a desired position.

When the gas manifold tube 104 and the stub tube 106 are connected, the second end 124 of the gas manifold tube 104 and at least a portion of the stub tube 106 are connectable in an axially overlapping arrangement. The axial overlap between the gas manifold tube 104 and the stub tube 106 may have any suitable length to facilitate flow from the fuel source 32 to the burner assembly 40. In an embodiment, as shown in the FIGS., the axial overlap may be limited to the portion of the stub tube 106 disposed external to the conduit 108. In other embodiments, the overlap of the gas manifold tube 104 and the stub tube 106 may extend into the conduit 108.

In an embodiment, the second end 124 of gas manifold tube 104 is inserted into the hollow interior of the stub tube 106. In such embodiments, the outer diameter of the second end 124 of the gas manifold tube 104 is smaller than the inner diameter of the stub tube 106. In another embodiment, the stub tube 106 is received within the hollow interior of the second end 124 of the gas manifold tube 104. In such embodiments, the outer diameter of the stub tube 106 is smaller than the inner diameter of the second end 124 of the gas manifold tube 104. When the gas manifold tube 104 and the stub tube 106 are connected, the gas manifold tube 104 and the stub tube 106 are mounted generally concentrically, and in some embodiments, a small clearance exists between the stub tube 106 and the adjacent surface of the gas manifold tube 104. In such embodiments, a seal may, but need not be positioned between the adjacent surfaces of the stub tube 106 and gas manifold tube 104. However, in other embodiments, the gas manifold tube and the stub tube 106 may be in direct contact, such as via a press-fit connection for example.

By designing the manifold assembly 34 to include a slip joint formed between the gas manifold tube 104 and the stub tube 106, the subassembly of the gas valve 32 and gas manifold tube 104 may be installed to the burner assembly 40 on the manufacturing line without installing an inefficient and time increasing gas fitting. As a result, special equipment, in particular tools, required to install and tighten a gas fitting inside a furnace are no longer required.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A furnace comprising:

a heat exchanger including a plurality of coils;

a burner unit including:

a burner box defining a mixing chamber for receiving a mixture of fuel and air;

a burner assembly including at least one burner arranged within the mixing chamber and being substantially aligned with at least one of the plurality of coils;

a fuel source; and a gas manifold assembly extending between and fluidly coupling the fuel source and the burner box to deliver fuel to the burner assembly, wherein the gas manifold assembly is connected to the burner box via a slip joint, wherein the gas manifold assembly further comprises:

a gas manifold tube connected to and extending from the fuel source; and a stub tube mounted to and arranged in fluid communication with the burner assembly, wherein an end of the gas manifold tube is connectable to the stub tube to from the slip joint.

2. The furnace of claim 1, further comprising a conduit supporting the stub tube.

3. The furnace of claim 2, wherein an end of the stub tube extends beyond an end of the conduit.

4. A method of assembling a burner unit of a furnace, comprising:

rigidly mounting a stub tube within a conduit extending from a burner box;

affixing a bracket extending from a fuel source to an exterior surface of the burner box; and connecting a gas manifold tube extending from the fuel source to the stub tube to form a slip joint, wherein connecting the gas manifold tube to the tube further comprises at least of: (i) forming an axial overlap between the gas manifold tube and the stub tube, and (ii) concentrically mounting the gas manifold tube and the stub tube.

* * * * *